US006655817B2

(12) United States Patent
Devlin et al.

(10) Patent No.: US 6,655,817 B2
(45) Date of Patent: Dec. 2, 2003

(54) REMOTE CONTROLLED LIGHTING APPARATUS AND METHOD

(76) Inventors: Tom Devlin, One Fitchburg St. #C305, Arlington, MA (US) 02143; Lee Weinstein, 35 Fairmont St. #3, Somerville, MA (US) 02474

( * ) Notice: Subject to any disclaimer, the term of this patent is extended or adjusted under 35 U.S.C. 154(b) by 0 days.

(21) Appl. No.: 10/016,671

(22) Filed: Dec. 10, 2001

(65) Prior Publication Data

US 2003/0107888 A1 Jun. 12, 2003

(51) Int. Cl.[7] ..... F21V 2/00
(52) U.S. Cl. ..... 362/233; 362/276; 362/802
(58) Field of Search ..... 362/233, 276, 362/802, 272, 286, 283, 232

(56) References Cited

U.S. PATENT DOCUMENTS 4,598,345 A * 7/1986 Kleeman ..... 362/233
5,590,955 A * 1/1997 Bornhorst et al. ..... 362/324
6,169,377 B1 * 1/2001 Bryde et al. ..... 315/294

* cited by examiner

*Primary Examiner*—Sandra O'Shea
*Assistant Examiner*—Guiyoung Lee

(57) ABSTRACT

A remote-control modular lighting system allows users to select individual lighting modules for adjustment by momentarily pointing the remote control at the lighting module to be adjusted. Subsequent adjustments may be done without aiming at the lamp, allowing the operators attention to be on the subject being lit. Control functions may include aiming of the light, power on/off, dimming, etc. In one preferred embodiment, individual lamps broadcast an identifier code to be stored in the remote. This allows the remote to adjust groups of lamps, or change a group of lamps to a particular stored configuration. This functionality is achieved without the requirement of special set-up procedures during installation.

21 Claims, 5 Drawing Sheets

REMOTE CONTROLLED LIGHTING APPARATUS AND METHOD

The present invention relates in general to modular lighting systems, remote control, and laser pointers, and more specifically to remote-controlled lighting systems.

BACKGROUND

Various remote-controlled lighting systems have been developed over the years. Examples include systems tailored for use in surgical environments, security systems, theater, and hazardous environments. Many of these systems have been very ruggedly designed and are expensive to manufacture. Some systems have incorporated multiple, individually controlled lighting units. The interfaces for the multi-unit systems have been complex, generally requiring a trained operator. In multiple-unit systems, the control function has generally been implemented either over dedicated wires, or over a common information channel, utilizing a separate address code to selectively control individual units. Various mechanical embodiments of motorized pan and tilt mechanisms have been developed.

U.S. Pat. No. 4,306,297, issued to Cohen on Dec. 15, 1981 describes a remote-controllable recessed lighting fixture with pan and tilt features. This design is intended for use in suspended ceilings. Although this design potentially allows for a full 180 degrees (or more) of pan, it is limited to significantly less than 90 degrees of tilt, so the light beam cannot sweep out a full 2° steradians of solid angle. Hard-wired remote control significantly increases the expense of installation and limits the ease of remote control.

U.S. Pat. No. 4,112,486, issued to Tovai on Sep. 5, 1978 describes a remote-controlled positioning device comprising a fixed base with a rotating shaft. A second shaft is mounted to the first shaft at right angles, and a head unit is mounted to and rotatable about the second shaft. The power and control signals for the head unit are transmitted through a flexible cable between the rotating head unit and the fixed base. This design allows for a full 180 degrees (or more) of pan, and a full 180 degrees of tilt, thus allowing a directed light beam to sweep out 2° steradians of solid angle. No specific means of remote control is claimed, but the preferred method is hard-wired. This design is expensive to manufacture for several reasons. First, two separate housings are equipped with motors. Second, the flexible cabling must carry both the control and power signals. This makes the cable more expensive, and opens up a potentially dangerous failure mode where a worn cable allows high-voltage power wiring to short to the control wiring of the motors. Again, hard-wired remote control significantly increases the expense of installation and limits the ease of remote control.

U.S. Pat. No. 5,347,431, issued to Blackwell et. al. on Sep. 13, 1994 describes a multi-unit remote controlled lighting system for a surgical environment, where individual lighting units may be supplied with light from a central source via fiber-optics. Remote positioning is accomplished via cable control.

U.S. Pat. No. 4,392,187, issued to Bornhorst on Jul. 5, 1995 discloses a multi-unit cable-controlled lighting system for theater use. Remote units are controlled by coded signals over a two-conductor control bus, and powered by a separate two-conductor power bus. Controlled functions include pan, tilt, and dichroic filtering of projected light. This system is complex and costly to install. In addition, each remote unit must have its address physically set differently from the other units in order to be individually controllable. The control interface is complex, requiring a trained operator.

U.S. Pat. No. 5,406,176, issued to Sugden on Apr. 11, 1995 describes a computer-controlled array of remote light stations which execute a pre-programmed timed sequence of functions.

U.S. Pat. No. 4,779,168 describes a remote-controlled lighting system for use on a vehicle, where the remote pan and tilt functions may be controlled either via hard-wired means or via a wireless transmitter. The wireless option allows flexibility, but does not teach individual control of multiple units by the same remote.

U.S. Pat. No. 5,031,082 issued to Bierend on Jul. 9, 1991 discloses a system for the remote control of multiple modular lighting units where pan, tilt, and on/off functions are controlled via coded signals sent over standard AC power lines. This system offers the advantage that dedicated control wiring is unnecessary, reducing cost and installation time, and making modifications easier. However, this system still requires individual lighting modules to be set on a unique "channel", and the operator must have knowledge of the channel assignments to actuate the desired light from the remote control panel. Thus some training is required to gain facility with the remote control.

Two major lighting markets exist in which remote-controlled lighting could be of great utility, but where remote-controlled lighting systems known in the art do not adequately serve the needs of the market. The first major market is retail store lighting. Most major retail establishments have a large number of ceiling-mounted track lights (often packed in tight groups) which are regularly re-aimed provide the best lighting as merchandising displays are changed and moved. The re-aiming of these lights is a costly, labor-intensive process, usually involving people going up tall ladders in the middle of the night aiming lights by hand. Often the process requires additional moving of merchandise to position the ladder. It is an object of the present invention to provide an economical modular remote-controlled lighting system which allows easy, intuitive selection of individual lights from within a tightly packed group of lights at distances of 20 or 30 feet. It is a further object of the present invention to provide a modular remote-controlled lighting module which dramatically reduces labor costs in configuring merchandising displays, and which may be used as a direct replacement for non-remote-controlled modules in existing installations, with no increase in installation cost over non-remote-controlled systems.

The second major market not adequately addressed by today's remote-controlled lighting systems is the consumer market. As mentioned in the individual descriptions above, remote-controlled lights known in the art all have limitations such as cost, difficulty of installation, safety, and complexity of user interface, which limit their appeal to the consumer market. In addition, many of the above-described devices are bulky and would not be considered aesthetically suitable for installation in the home, where aesthetics are important. It is an object of the present invention to improve upon the features available in the afore-mentioned devices provide a compact, elegant, economical remote-controlled modular lighting system with a simple, intuitive user interface.

Often stores may have repeated seasonal patterns of displaying merchandise. It is a further object of the present invention to save on needed labor and expertise traditionally needed to re-adjust lighting to previously set display conditions.

The most popular system for remote control of home lighting today is the X10 system (available through Radio Shack and X10.com). Remote controls in the X10 system require the user to know which button on a multi-button remote goes with which light. One of the uses for remote-controlled lighting in the home is to be able to quickly set up various moods and modes in lighting a given room. A mood such as "romance" might call for soft lighting. A mode such as "watching TV" might call for certain lights in the room to be off so they don't cause glare on the TV screen. The X10 system does not allow for pre-programmed moods and modes for sets of lights. It is an object of the present invention to facilitate returning a set of lights to a given mood or mode with the simple pressing of a couple of buttons.

SUMMARY OF THE INVENTION

The present invention provides a new means and method for implementing a modular remote-controlled lighting system. This is accomplished through a novel remote control interface with both directional and omni-directional components, in conjunction with low-cost, easily manufacturable lighting modules which allow remote control of pan and tilt, power, and brightness for each lamp. In a preferred embodiment, the user uses a built in visible laser pointer in the remote control to select the lamp module to be adjusted. An indicator on the lamp module lights to show which lamp has been selected, and the selected lamp then transmits its unique address (via infrared or RF) to the remote control. Once the lamp is selected, subsequent remote commands may be transmitted (preferably via RF) to the selected lamp module without pointing at that lamp. Thus once a lamp has been selected, the operator's attention may be directed toward the subject being lit. This combination of directional and non-directional control provides both intuitive selection and intuitive adjustment after selection. The operator may then control the desired functions of the lamp module (i.e. tilt up, tilt down, pan left, pan right, brighten, dim, on, off), while simultaneously observing the results.

Each modular pan and tilt mechanism allows for a full 2° steradians (for instance the bottom half of an imaginary sphere) of solid angle to be swept out by the light beam being aimed. In one preferred embodiment, individual lighting modules are capable of storing a programmed timed sequence of actions and/or a set of pre-programmed settings of position, and brightness. In another preferred embodiment, the remote control is capable of memorizing settings for each lamp in a group, and returning each lamp in the group to its memorized setting with the push of one button. Many group settings can be stored in the remote, and the groups may overlap, so that some lamp modules are members of more than one group.

In a preferred embodiment, once a group of lights is selected, the user may cycle through the individual lamps of the group with the simple press of a button, without having to point at each lamp to select it. Light groups may be selected by selecting an individual light that is part of the group, and then cycling through all the groups that lamp is part of, by pressing a button on the remote. In a preferred embodiment, the remote has an alphanumeric display, and allows the user to name groups. Groups may also be distinguished without being named, by cycling through the groups and watching the individual LED indicators on the lamps in each group light up as the group is selected.

The present invention allows the safe and convenient adjusting of lights that are our of reach, or not visible to a person viewing the subject being lit. For example, the present invention is ideal for adjusting lights on tall ceilings, or adjusting the lighting of a store window display while standing outside the store on the sidewalk. Remote control allows easy adjustment while observing the lighting conditions as they will finally be seen.

Individual lighting modules may be caused to internally store and return to different lighting settings, where such settings can be recalled on either an individual or group basis. In a preferred embodiment, the present invention utilizes position-sensing mechanisms within the lighting modules to store position information. Positioning is done open-loop, and then the position information is sensed and can be stored in the lamp module or the remote, along with brightness settings for later recall. In a consumer setting, this feature might be used to store brightness and position settings for a group of lamps for later recall as "TV-watching lighting", "romance lighting", "reading lighting", "dining lighting", etc.

During the programming phase, the individual lamps are controlled individually. Once the individual lamps in a system have been programmed with different position settings for different lighting "modes", the entire system can be put into a given mode with the push of a button. In a consumer setting, for instance, one might enter the living room and press the "reading mode" button, causing all the lamps to point toward the chairs and couch. Pressing the "romance mode" button would cause all the lamps to point toward the walls and dim. Pressing "TV mode" would cause all the lamps at one end of the room to go out, and the lamps at the other end of the room to dim and point toward the wall. Thus the invention provides a new versatility of for home lighting as well as commercial lighting.

The present invention provides a safe electromechanical design which is economical to manufacture. Safety is insured through a novel design where all control electronics and servo motor mechanisms are contained within a single central housing. Thus if any external cabling is used, only power wiring is run within the external cabling. In a preferred embodiment, power is routed through slip rings within the two rotating joints, allowing 180 degrees of rotation at each joint with no danger of wearing or catching a cable. These design features minimize the risk of any short between power wiring and the control electronics (which could cause fire or injury). The single central housing allows for economical sub-assembly of the electronics and drive mechanisms. The Pan and tilt mechanisms use identical motor/drive sub-modules, allowing simplified manufacturing inventory and reducing manufacturing cost. Novel electro-mechanical design within the central housing allows a common plane of rotation of the pan and tilt motors, allowing both motor/drive modules to be mounted on a common Printed Circuit (PC) board. The incorporation of all electronic and electro-mechanical components onto a single PC board represents a significant advance in manufacturability over previous remote-controlled pan and tilt mechanisms. This assembly technique allows the use of automated assembly equipment and eliminates hand-wiring, greatly reducing manufacturing cost and increasing reliability. The housing of the unit is compact, and suitable for either injection molding or die casting, allowing rugged, economical mass-production.

It is a further object of the invention to provide a rugged, reliable remote-controlled lighting unit suitable for installation and adjustment by unskilled consumers. Novel slip-clutch means integral to both the pan and tilt mechanisms of the unit allow the unit to be manually adjusted without damaging or putting undue stress on the servo drive mechanisms. The position encoders provide an accurate electronic sensing of the lamps position, whether it is adjusted by hand or with the remote. Thus, even hand adjusted settings may be "learned" by the remote, and returned to later. This allows consumers to aim the lamp units by hand when installing them, or at any time that manual aiming is deemed convenient. The slip-clutch feature also prevents damage should the lamp encounter a physical obstruction while being remote-controlled.

Those skilled in the art will recognize the above described features and improvements of the present invention as well as other and further objects, features, and advantages that will become apparent from the following description of presently preferred embodiments of the invention given for the purpose of disclosure.

DETAILED DESCRIPTION

Figure 4:
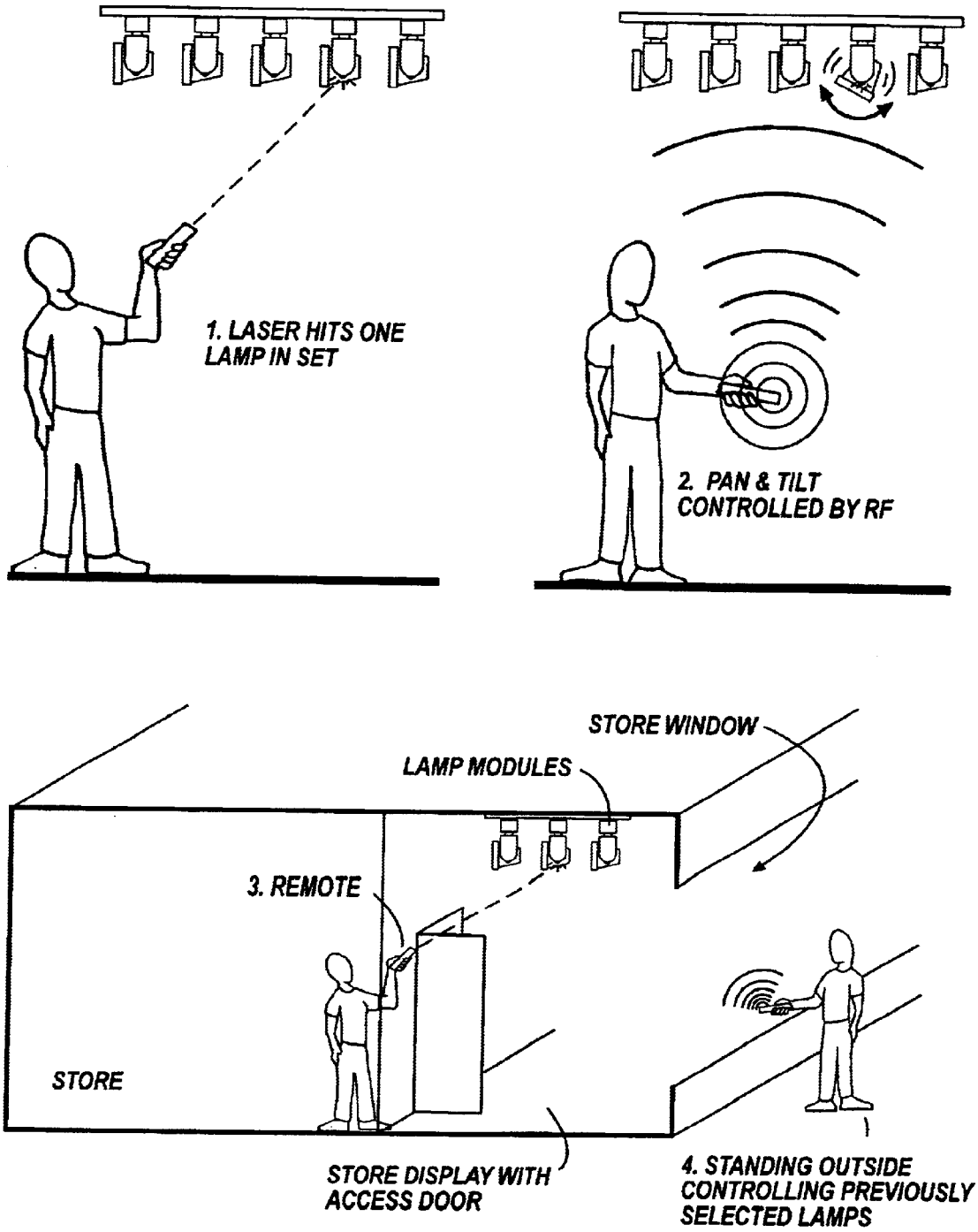
FIG. 4 depicts one of several installed remote-controlled track lighting units being adjusted via directional remote-control (laser-point select and non-line-of-site control).
Figure 5:
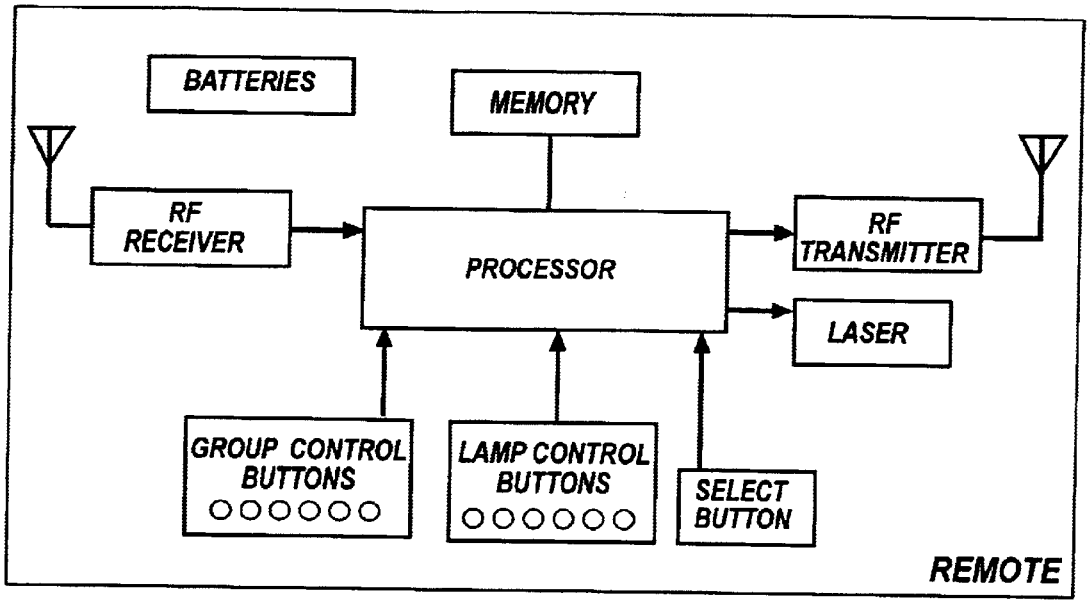
FIG. 5 is a block functional diagram of the remote control lamp system, including the remote control transmitter and an exemplary remote-controlled lamp module.
Figure 5:
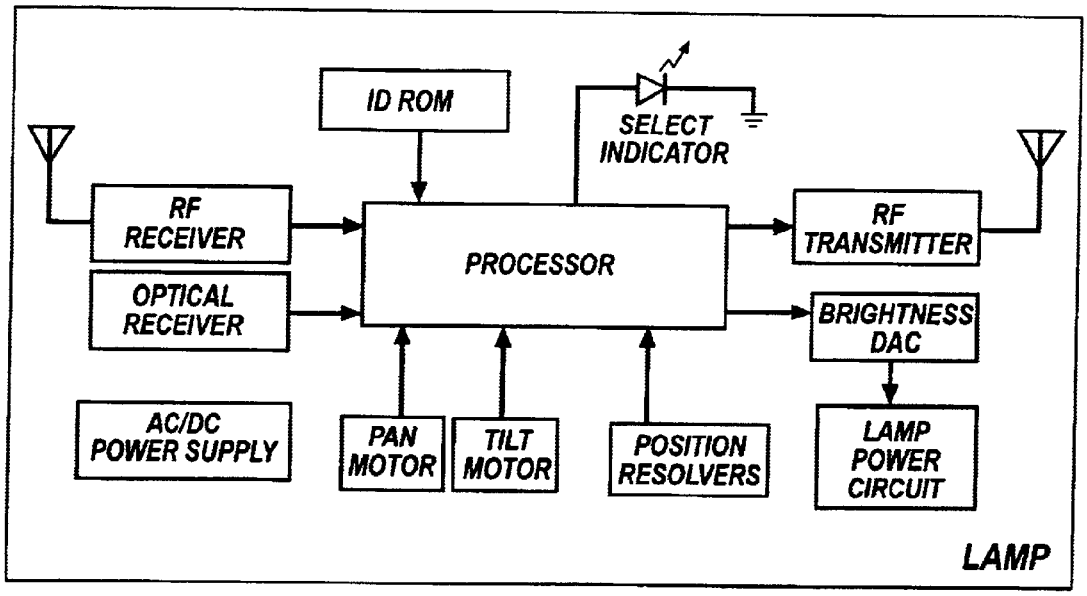

Referring to FIG. 4, a preferred embodiment comprises a hand-held remote control transmitter and a plurality of remote-controlled lamp modules. The modules used for purposes of this description are track-mounted, but fixture-mounted, wall-mounted, or table-top modules could equally well be used. Modules may be controlled either individually or as a group. For individual control, the remote control is pointed at the lamp module to be controlled and a "select" button is pressed. An indicator lamp on the module selected lights to show that the module is ready to accept omni-directional remote control commands. Once the indicator lamp is lit, it is no longer necessary to point the remote control at the lamp module to control it.

Preferably, omni-directional control may be used either to control a single lamp module after directional selection, or to control all modules simultaneously. For simultaneous control, a user may either issue a given command (such as "on" or "off") to all lamps, or the user may recall a stored state of the entire system (stored as individual states in the memories of the individual modules), by pressing a button such as "TV mode", or "romance mode". In omni-directional mode the remote control transmits commands preferably over a coded Radio Frequency (RF) signal, received by RF receivers in each lamp module. These coded RF transmissions contain address information identifying them as being for a specific module, or for all modules. When a specific module has been selected by pointing and selecting, that module's address is acquired by the remote control so that its address can be attached to subsequent RF control information.

When using the directional optical means to select a lamp module, the user may select a number of lamp modules successively. In a preferred embodiment, each successively selected lamp module transmits its ID (optically or via RF) to the remote, and the remote stores the recent succession of lamps selected. The remote can then cycle back through selecting the recently selected lamps (via coded optical or RF selection instead of directional optical selection). This allows the user to sequentially point at and select a set of lights that light a particular merchandise display (for instance, a store window display). The user can then stand in a place to view said display, and sequence through the previously selected lights and adjust them for the desired visual effect. This cycling can be done even if none of the lamp modules are visible from where the user stands to observe the display and control the lights.

Directional selection preferably takes place through one of two embodiments: In the first embodiment, the remote control initiates selection of the lamp module by directionally beaming transmitting an optical signal (either infrared (IR), such as used in TV remotes and the like, or a visible beam, such as used in laser pointers). The optical signal is preferably a modulated signal. The directional optical signal impinges on and is received by an omnidirectional optical receiver 30 (FIG. 1) in the module to be selected. The selected module then lights a visual indicator lamp 58 alerting the user that selection was successful. Within this embodiment, any subsequent commands (whether addressed for "all" or not) received over the selected lamp module's RF receiver 56 shall be carried out by the selected lamp module. De-selection takes place either by receiving the "end" command, or by a predetermined length of time elapsing since the last command was sent. If this embodiment of directional selection is used, and lamp modules must be selected from within tightly spaced groups, it is preferable to use a laser diode as the directional optical source.

Figure 3:
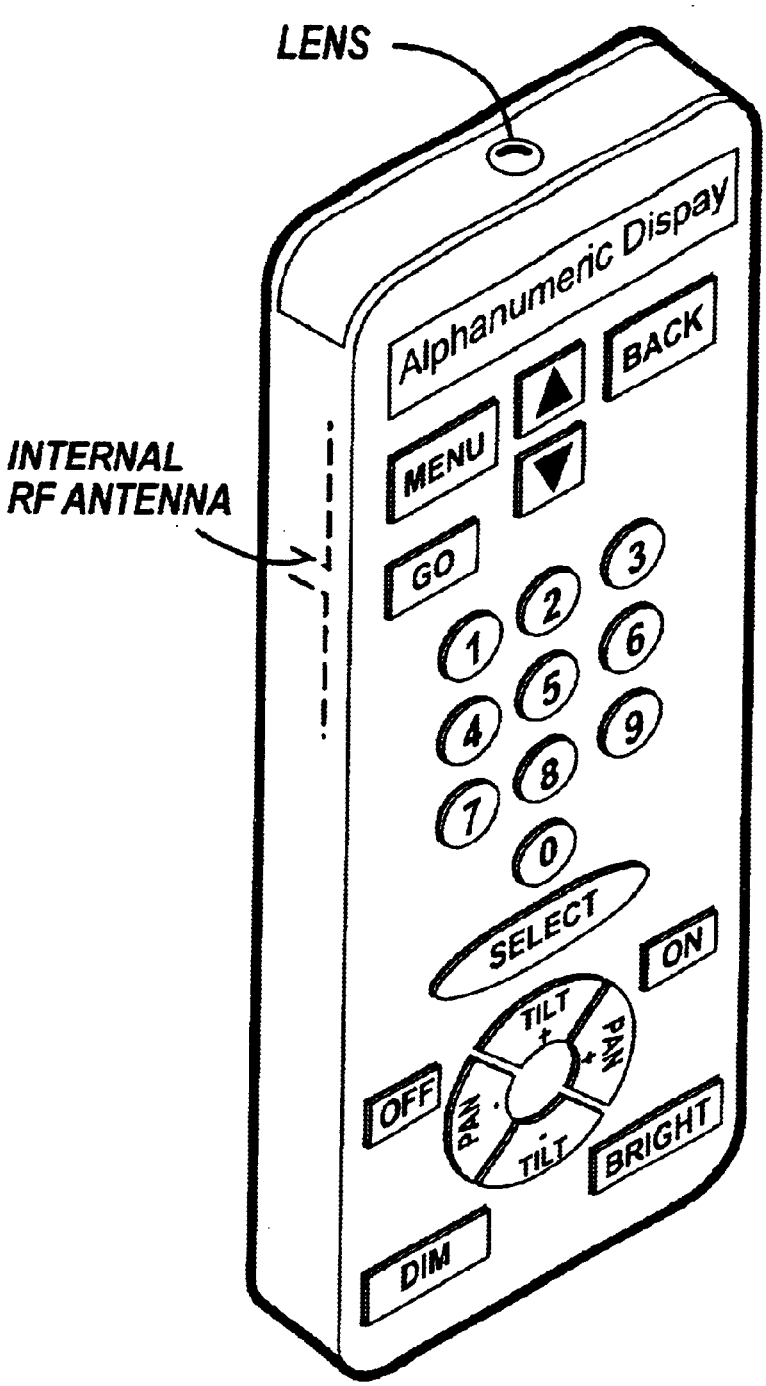
FIG. 3 is an isometric view of a remote-control transmitter incorporating directional optical means for selecting one of a plurality of fixtures to be controlled, showing control interface and collimating lens.

In the second embodiment of directional selection, the remote control initiates selection by transmitting an omni-directional command to all lamp modules requesting them to identify themselves. All modules respond by sending out a coded optical signal via omnidirectional optical transmitter 30. The remote control "looks" for a response through directional optical receiver lens (FIG. 3). Since the remote control is only "looking" at the lamp module being selected, it only sees the response from that module (even though all modules responded). The response from the lamp module contains the lamp module's unique ID number. This number is then stored in the remote control and appended to subsequent RF commands intended to control the selected module. Thus other modules will not respond to these commands. An initial "acknowledge" command may be sent out by the remote once the ID number of the lamp module being controlled is received, causing the lamp module to light visible indicator 58 for visual verification by the user.

If this second embodiment of directional selection is used, a further feature is desirable to select between tightly spaced groups of lamp modules, because it is difficult for the user to know exactly which lamp module is being pointed at. The added feature allows the user to point in the general direction of the lamp to be selected. All ID responses are received from all lamp modules in that direction by the remote, and the remote memorizes a set of ID numbers. The user may then cycle through the selected lamps by pressing the select button repeatedly, until the indicator on the desired lamp module lights. This feature necessitates an intelligent time staggering or response time randomizing algorithm to allow the remote to receive all ID numbers without the signals from different lamp modules colliding in time. This may be statistically accomplished in a fraction of a second, and is transparent to the user. Although the processor algorithms for this feature are complex, they do not need to increase the cost of the system, and since directional optical receivers are much cheaper than laser diodes, an this method makes the pointing of the remote less critical, this second method of directional selection is preferred.

Preferably at least 4 functions may be controlled: on/off, brightness, and two degrees of mechanical freedom, allowing the beam of the lamp module to be directed. For track-mounted systems, it is preferred that each lamp module allow a complete half-sphere of solid angle to be swept out by the lamp as it is pointed. This allows pointing at locations anywhere on any wall and anywhere on the floor (for a ceiling-mounted lamp module).

Figure 1:
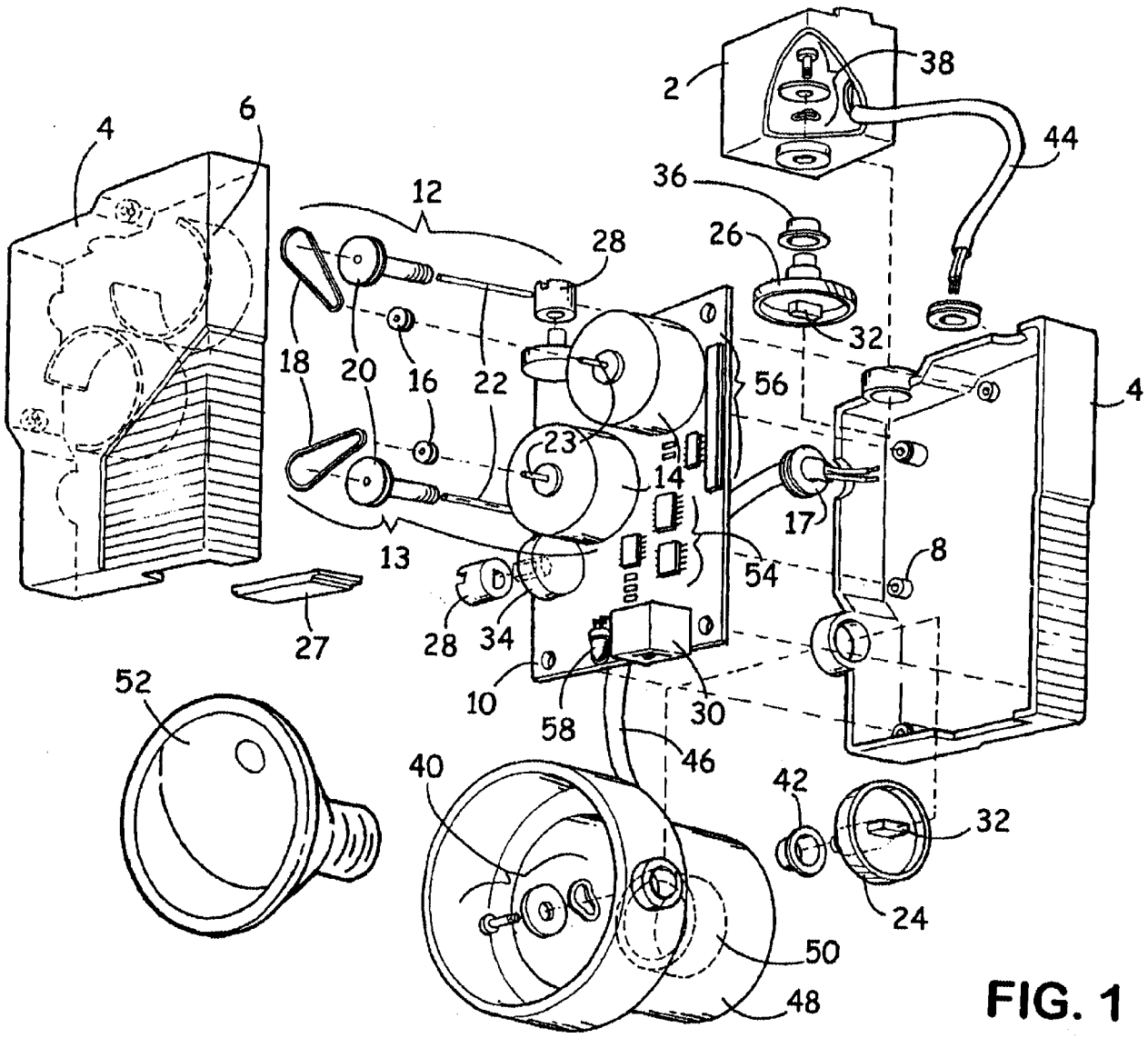
FIG. 1 is an exploded view of a remote-controlled track lighting module, showing the lamp housing, control housing, track interface, and printed-circuit-mounted electronics and servo drive mechanisms.
Figure 2:
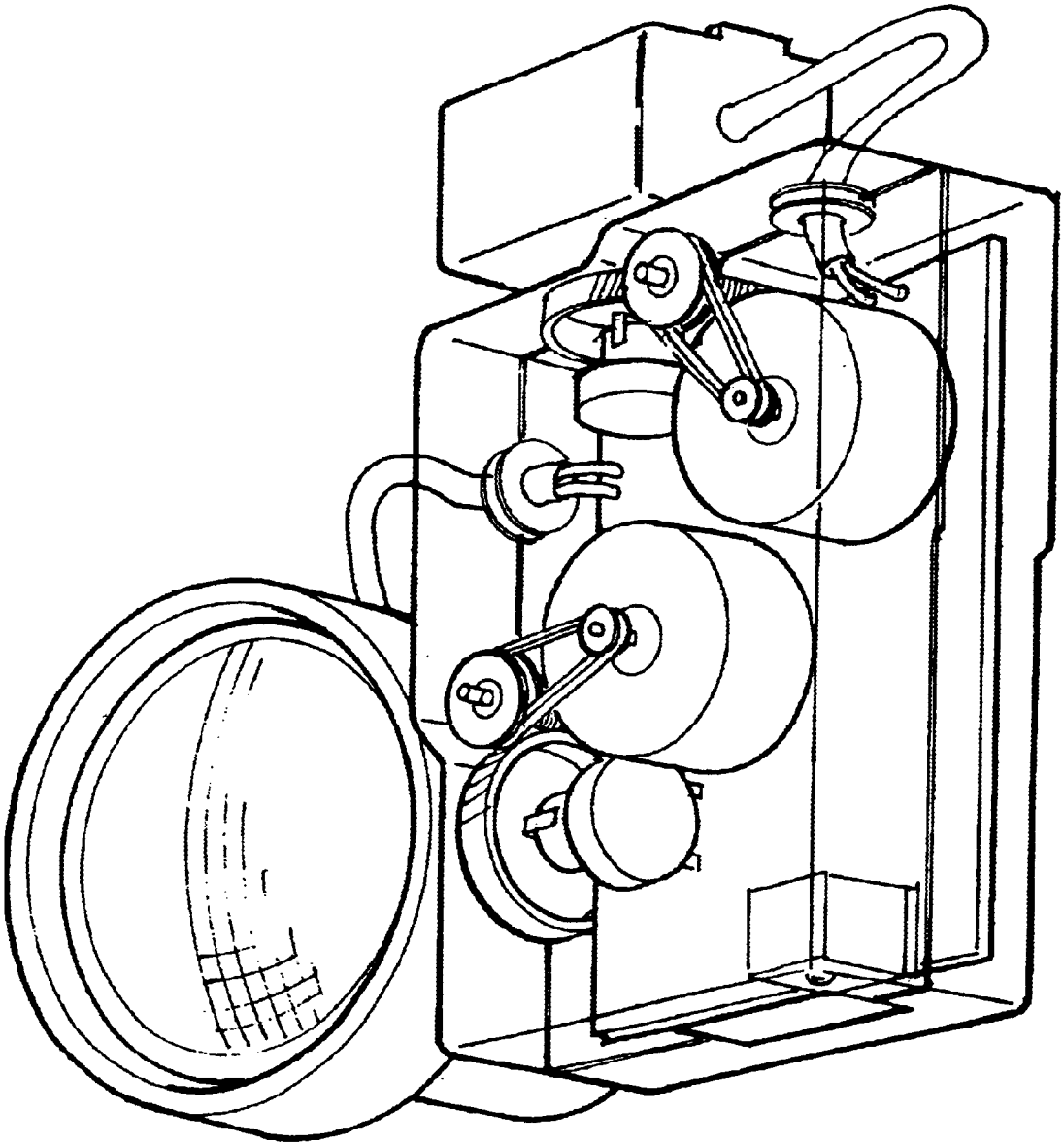
FIG. 2 is a partially transparent view of a fully assembled remote-controlled track lighting module, including control housing which rotates on an axis relative to the track interface, and lamp housing which rotates on an axis relative to the control housing.

A typical ceiling-mounted track lighting module used a preferred embodiment is shown in FIG. 1. Mounting base 2 is designed to interface with one or more existing power tracks presently in use in track lighting systems. Housing 4 is mounted to base 2 by and rotatable about axle/drive gear 26. Axle/drive gear 26 remains fixed with respect to base 2, and housing 4 is free to rotate about axle/drive gear 26 on bushing 36. Axle/drive gear 24 remains fixed with respect to luminary 48 (affixed by mounting hardware 40), and rotates luminary 48 with respect to housing 4 on bushing 42. Electric power for lamp 52 is conducted from housing 4 to socket 50 within luminary 48. Electric power for the lamp and electronics of the lamp module are conducted from the base to the housing via first power cable 44. Second power cable 44 conducts power from PC board 10 to luminary 48. Housing contains PC board 10, on which are mounted control electronics 54, infrared transmitter or receiver 30, RF receiver electronics 56, and servo mechanisms 12 and 13. Optically transparent window 27 allows receiving & transmitting of optical signals by optical transceiver 30 through housing 4. Servo mechanisms 12 and 13 are identical and oriented such that their output shafts (24 and 26) are at right angles to one another. Each servo mechanism is composed of a motor 14 with an output shaft 23, a pulley 16 mounted on the output shaft, a drive belt 18 transmitting power to a reducing pulley/worm gear 20 (which rotates on axle 22, and an output axle/drive gear (shown as 26 for servo mechanism 12 and as 24 for servo mechanism 13). The combination of belt drive and worm drive used in the servo mechanisms results in very quiet operation. For systems equipped with the internal memory feature, rotary positional resolvers 34 (implemented in a preferred embodiment as potentiometers) are coupled via couplers 28 keyed by feature 32 to output shafts 26 and 34, enabling the unit sense its position so that it can return to pre-stored positions. Mechanical stabilizers 6 may be molded in to the housing, supporting the motors against mechanical shock and vibration. Bearing features 8 may be molded into the housing, reducing cost of assembly of the servo mechanisms and reducing parts count. Mounting hardware 40 is implemented to provide clutch action and allow the slippage of the luminary with respect to the housing and of the housing with respect to the base if forced manually. This prevents breakage.

In the second (preferred) directional control embodiment, control electronics 54 contains a microprocessor with on-board RAM and ROM, which "listens" to RF receiver 56 and angle resolvers 34, and "talks" to omnidirectional optical transmitter 30, indicator LED 58, and the drive electronics for servo motors 14. For consumer applications, the control electronics 54 incorporates non-volatile memory to store different settings, and resolvers 34 for feedback purposes in returning to pre-set positions. If potentiometers are used for resolvers, a n analog-to-digital (A/D) converter converts the position of the resolvers into digital form for the processor. If a digital "pinwheel" is used with optical pickups to implement the resolvers, no A/D is necessary. Non-volatile memory may either be implemented as CMOS RAM in the processor, backed up by a coin cell battery on the circuit board, or as FLASH memory so that no backup battery is necessary. Flash memory is preferable for long-term reliability and pre-set retention regardless of the length of a power outage.

A preferred embodiment of the remote control is shown in FIG. 3. The alphanumeric display, numeric keypad, up, down, menu, back, and go buttons present a user interface similar to a Nokia cellular phone, allowing the user to define and recall lamp groups by name. Pressing the select button causes a modulated visible red laser beam to emerge through the collimating lens. Hitting the optical window of any lamp module to be remote-controlled will initiate the selection of that lamp module. (A frosted translucent light pipe may circumscribe the lamp body and be optically coupled to the optical receiver of the lamp, to make the lamp an easier target to hit and select.) In a preferred embodiment, when the modulated laser is detected by the lamp module, the lamp module transmits its ID code back to the remote control via RF. That ID number is then stored in the remote as a member ID of the current working group of lamps, and it is also stored in the remote as the current actively controlled lamp. The remote then transmits a remote enable command to the currently selected lamp. When the currently enabled lamp receives the enable command that is addressed to its ID, it turns on a visible indicator which can be seen through its optical window, indicating that it is currently under remote control. Selecting another lamp with the modulated laser pointer will release the previously selected lamp from immediate remote control, but ID's of both will remain in the memory of the remote as members of the current working group, so that control of them may be cycled via RF command without having to point at them. This allows sequentially selecting a group of lights, then standing at a vantage point to view the display being lit by those lights, and cycling through and adjusting those lights one at a time without having to point at them.

Simple variations and additions to the above embodiment, such as control of lamp beam color and divergence, storage and recall of timed sequences, and programming and control of sub-groups of remote-controlled lamp modules, are contemplated and are within the scope of this invention.

CLAIMS

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Having described the invention, what is claimed is:

1. A method for controlling a remote-controlled lamp, comprising:

a. Establishing highly directional optical communication between a remote control and a remote-controlled lamp;

b. Using said highly directional optical communication to establish omnidirectional wireless communication between said remote control and said remote-controlled lamp; and c. Controlling said remote-controlled lamp through said omnidirectional wireless communication.

2. The method of claim 1, wherein the step of establishing said highly directional optical communication between said remote-controlled lamp and said remote control comprises transmitting optical information in a highly directional beam from said remote control to said remote-controlled light.

3. The method of claim 2, wherein the directionality of said beam is such that the majority of the power in said beam is transmitted within 0.001 steradians of solid angle.

4. The method of claim 2, wherein said directional optical communication comprises transmitting information from a laser diode to an omnidirectional receiver.

5. The method of claim 2, wherein the step of establishing omnidirectional wireless communication between said remote control and said remote-controlled lamp further comprises enabling an omnidirectional command receiver in said lamp.

6. The method of claim 5, further comprising disabling said omnidirectional command receiver if a command is not received for a predetermined period of time.

7. The method of claim 5, further comprising disabling said onmidirectional command receiver in response to a disable command received through said omnidirectional command receiver.

8. The method of claim 1, wherein said directional communication comprises omnidirectionally transmitting from an omnidirectional transmitter in said remote-controlled lamp to a highly directional receiver in said remote control.

9. The method of claim 8, wherein the directionality of said directional receiver is such that when said receiver receives a signal from equal-intensity transmissions from all directions, more than half the power in said signal is received from within 0.01 steradians of solid angle.

10. The method of claim 8, further comprising optically transmitting a unique identifying code from said omnidirectional wireless transmitter in said remote-controlled light to said highly directional receiver in said remote control, storing said code in said remote control, and subsequently tagging commands transmitted omnidirectionally from said remote control with said unique identifying code.

11. A remote controlled light system, comprising:

a. A remote-controlled lamp;

b. A remote control unit with a user interface;

c. An omnidirectional wireless transmitter;

d. An omnidirectional wireless receiver;

c. Means for establishing highly directional optical communication between said remote control and said remote-controlled lamp.

12. The remote-controlled light system of claim 11, wherein said means for establishing highly directional optical communication between said remote control and said remote-controlled lamp comprises a highly directional optical transmitter on said remote control, and an omnidirectional optical receiver on said remote controlled lamp.

13. The remote-controlled light system of claim 12, wherein said highly directional optical transmitter transmits more than 50% of its power within 0.001 steradians of solid angle.

14. The remote-controlled light system of claim 12, wherein said highly directional optical transmitter comprises a laser diode.

15. The remote-controlled light system of claim 12, wherein said omnidirectional wireless receiver is disposed in said remote-controlled lamp, and wherein said remote-controlled lamp further comprises circuitry responsive to optical communication, for enabling said omnidirectional wireless receiver.

16. The remote-controlled light system of claim 15, further timer means configured to disable said omnidirectional wireless receive if a command is not received by said omnidirectioanl wireless receiver within a pre-determined period of time.

17. The remote-controlled light system of claim 15, further comprising a humanly perceivable optical indicator disposed on said remote-controlled lamp, and further comprising means for illuminating said humanly perceivable optical indicator while said omnidirectional wireless receiver is enabled.

18. The remote-controlled light system of claim 11, wherein said means for establishing highly directional optical communication between said remote control and said remote-controlled lamp comprises a highly directional optical receiver in said remote control and an omnidirectional transmitter in said remote-controlled lamp.

19. The remote-controlled light system of claim 18, wherein the directionality of said highly directional optical receiver is such that when said receiver receives a signal from equal-intensity transmissions from all directions, more than half the power in said signal is received from within 0.01 steradians of solid angle.

20. The remote-controlled light system of claim 18, wherein said remote-controlled lamp further comprises non-volatile memory for storing a unique lamp identifying code, and means for transmitting said code via said omnidirectional transmitter.

21. A remote-controlled light, comprising:

a. A servo-adjustable luminary;

b. A wireless receiver;

c. Two servo motors with coincident planes of rotation, both mounted to a single printed circuit board;

d. Two identical 90-degree mechanical reduction drives, driven by said two servo motors, said reduction drive outputs arranged to be mutually perpendicular, and said two reduction drive outputs mechanically connected to control two mutually perpendicular axes of rotation of said luminary.

* * * * *